United States Patent [19]

Harter et al.

[11] Patent Number: 4,561,233

[45] Date of Patent: Dec. 31, 1985

[54] WALL PANEL

[75] Inventors: James W. Harter, Independence, Mo.; Gary S. Smagiel, Olathe, Kans.

[73] Assignee: Butler Manufacturing Company, Kansas City, Mo.

[21] Appl. No.: 488,730

[22] Filed: Apr. 26, 1983

[51] Int. Cl.[4] ..... E04C 1/30

[52] U.S. Cl. ..... 52/588; 52/521; 52/522; 52/542

[58] Field of Search ..... 52/543, 544, 545, 546, 52/547, 551, 520, 531, 536, 537, 538, 588, 478, 542, 521, 522, 519

[56] References Cited

U.S. PATENT DOCUMENTS

| | | | |
|---|---|---|---|
| 1,913,342 | 6/1933 | Schaffert | 52/537 |
| 2,565,610 | 8/1951 | Kinghorn | 52/522 |
| 3,100,556 | 8/1963 | De Ridder | 52/594 |
| 3,324,617 | 6/1967 | Knight et al. | 52/537 |
| 3,411,261 | 11/1968 | Soddy | 52/588 |
| 3,420,029 | 1/1969 | Martin | 52/584 |
| 4,109,437 | 8/1978 | Player et al. | 52/536 |
| 4,133,161 | 1/1979 | Lester | 52/537 |
| 4,266,385 | 5/1981 | Oehlert | 52/543 |
| 4,283,897 | 8/1981 | Thompson | 52/520 |
| 4,296,581 | 10/1981 | Heckelsberg | 52/520 |
| 4,406,106 | 9/1983 | Dinges | 52/543 |
| 4,522,007 | 6/1985 | Oehlert | 52/588 |

FOREIGN PATENT DOCUMENTS

| | | | |
|---|---|---|---|
| 1571961 | 6/1969 | France | 52/595 |
| 2453353 | 10/1980 | France | 52/243 |

*Primary Examiner*—John E. Murtagh
*Assistant Examiner*—Andrew Joseph Rudy
*Attorney, Agent, or Firm*—Shoemaker and Mattare, Ltd.

[57] ABSTRACT

The wall panel includes a snap joint which permits hidden attachment of the wall panel to another wall panel. The joint permits the panel to be attached to building supports from inside or outside and permits easy attachment of liner panels, insulation, or the like. A projection on one panel abuts an angled leg of another panel to provide a secure snap engagement between the panels.

7 Claims, 7 Drawing Figures

WALL PANEL

BACKGROUND OF THE INVENTION

The present invention relates in general to building materials, and, more particularly, to wall panel units.

Currently there are many wall panel units available and an example of such units is disclosed in U.S. Pat. No. 4,283,897.

These units, however, have certain deficiencies which include panel joints which can gap, thereby creating unsightly gaps and creating air leakage. Many of the known panels must be installed from inside a building, thereby making it nearly impossible to use blanket insulation or like materials.

Furthermore, due to the design of many known units, attaching liner panels, such as wallboard or other such finishing materials, is extremely difficult.

SUMMARY OF THE INVENTION

The device embodying the teachings of the present invention includes means for forming a panel lap joint which produces a hidden tight joint.

The device includes a first locking edge on one panel which interlocks with a second locking edge on another panel. The first locking edge includes a center groove which interferes with an angled leg on the second locking edge. The center groove is in the back leg of the second edge and functions as a retaining bead when the panels are locked together. The groove cooperates with a leg on the second edge of the adjoining panel to provide a snap engagement between the two panel edges. The groove can extend for essentially the entire length of the panel, or only part of the length of the panel, as suitable.

The second edge fits into the first edge, and one of the panels is tilted with respect to the other during the locking procedure.

The panels can be easily installed from either the inside of the building or the outside of the building. The outside attachment expands the capability of the wall panel over the known wall panels and permits use of the unit on fascias, retrofitting, and the like.

Wallboard or other finishing products are easily attached to the presently disclosed panel because a leg on the second edge is shorter than a corresponding leg on the first edge, thereby facilitating the double attachment at a liner joint.

The center groove permits visual centering for a liner joint and can also be used as a guide for self-drilling screws in a blind attachment application.

OBJECTS OF THE INVENTION

It is a main object of the present invention to provide a hidden snap-in joint for connecting building wall panel units together.

It is another object of the present invention to permit wall panel units to be mounted from inside or outside a building.

It is a further object of the present invention to permit easy attachment of insulation, wallboard, or the like to building wall panel units.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
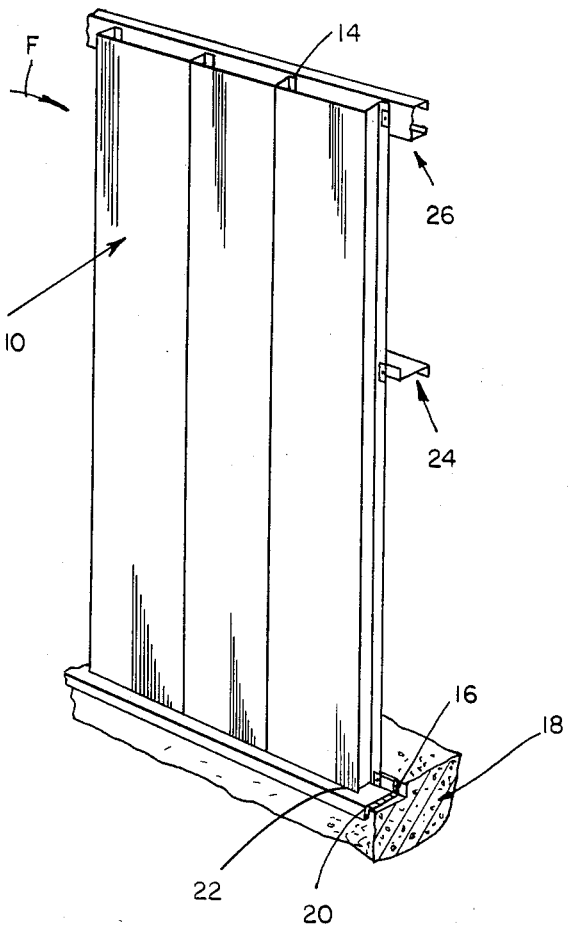
FIG. 1 is a perspective view of a planar wall panel unit embodying the teachings of the present invention.
Figure 2:
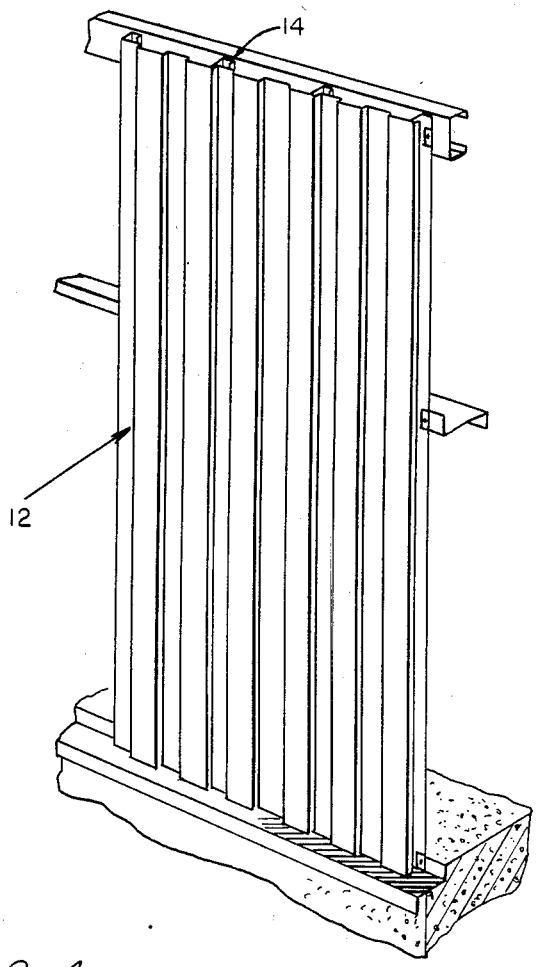
FIG. 2 is a perspective view of a fluted wall panel unit embodying the teachings of the present invention.
Figure 3:
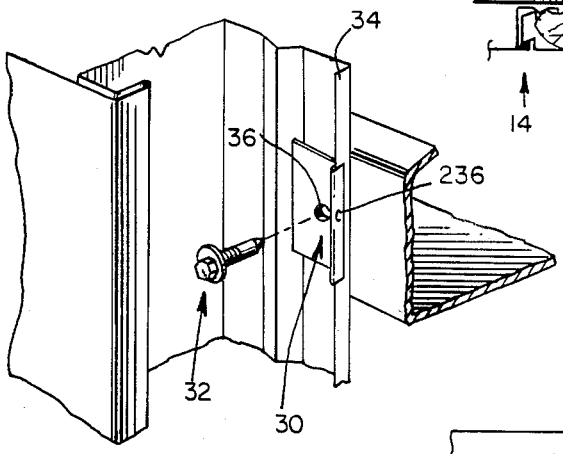
FIG. 3 is a perspective view of a clip used in conjunction with a wall panel unit embodying the teachings of the present invention.

A planar wall panel unit 10 and a fluted wall panel unit 12 are shown in FIGS. 1 and 2, respectively, and each unit utilizes a quick joint 14 embodying the teachings of the present invention. The planar wall panel 10 may include a textured coating to produce a non-metallic look, if suitable. The wall panel units are supported on a sill 16 of a foundation 18. A base closure 20 can be interposed between foot 22 of the units and the sill, if suitable. Wall structurals, such as girts 24 and eave struts 26, are used with the panels and a reinforcing clip 30 and a self-drilling screw 32 connect the panels to the girts and eave struts. The reinforcing clip has an indentation or dimple 236 formed therein that provides for a tight fit when the clip is pushed over the panel lip 34. The clip includes a hole 36 which functions as a pilot hole for self-drilling screw 32. The reinforcing clip also reinforces the fastener so it can resist wind suction forces.

Figure 6:
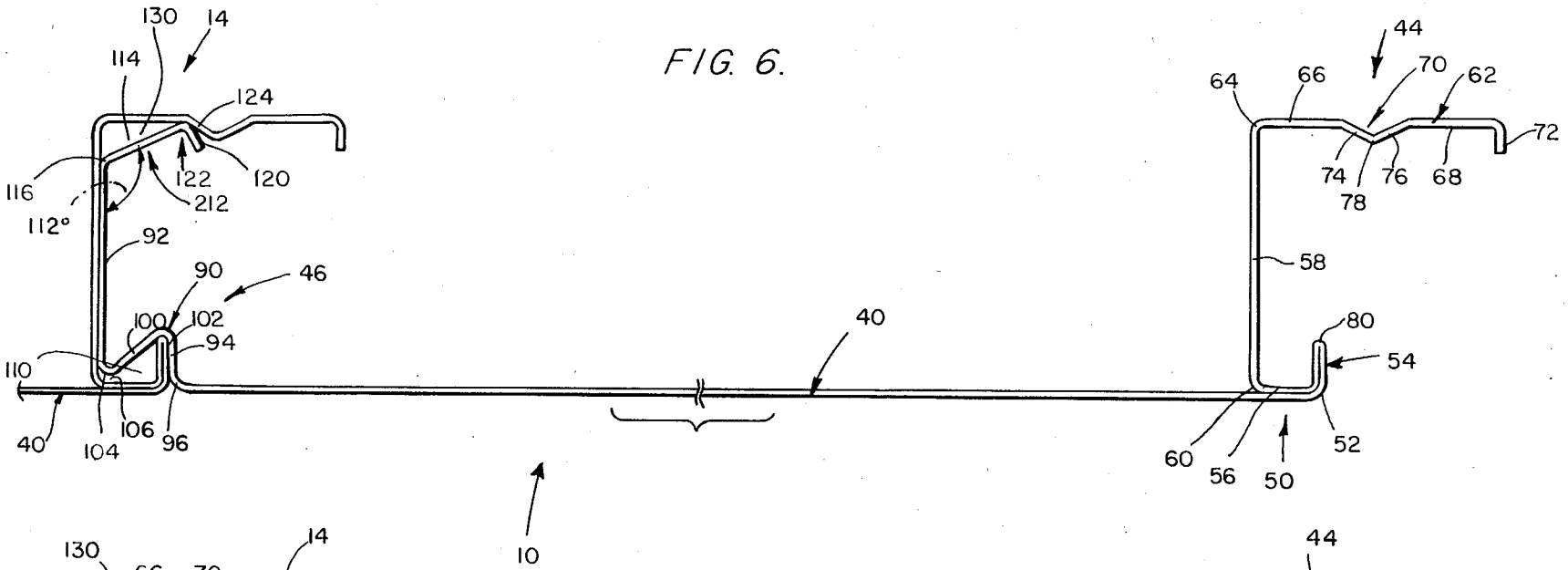
FIG. 6 is a top plan view of a planar wall panel unit showing the snap lock feature embodying the teachings of the present invention.
Figure 7:
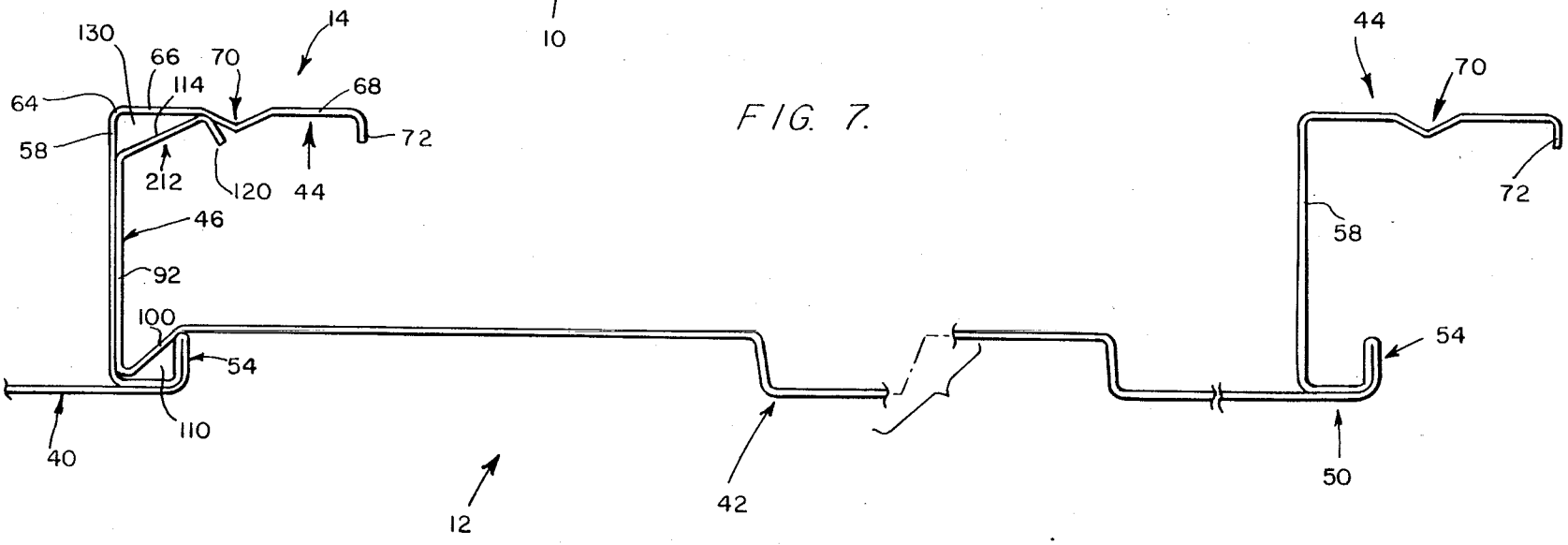
FIG. 7 is a top plan view of a fluted wall panel unit showing the snap lock feature embodying the teachings of the present invention.

FIGS. 6 and 7 show panel units 10 and 12 as each including a central portion 40 which is planar in panel 10 and which includes flutes 42 in panel 12. The quick joints 14 are formed by inter-nesting ends 44 and 46 of juxtaposed panels.

End 44 includes a hem portion 50 defined by knee 52, and hairpin portion 54 and a cross-web 56 which overlaps a portion of the central portion 40. The end 44 further includes a web 58 connected to the cross-web 56 by a corner 60 and which is connected to posterior first leg 62 of the end 44 by a corner 64.

The posterior first leg 62 includes a pair of coplanar lands 66 and 68 which are interconnected by a cleft portion 70, with land 66 being connected to the corner 64 and land 68 having a lip 72 on a distal end thereof. The cleft portion is in the form of an isoceles triangle and includes a pair of legs 74 and 76 connected together to form an apex 78.

In the preferred form, the apex 78 is located farther from the web 58 than is hairpin bend 80 of the hairpin section 54.

End 46 includes an offset section 90 connecting central portion 40 to a web 92. The offset portion includes a spanner leg 94 connected to the portion 40 by a corner 96 and a sideways declining ramp 100 connecting the leg 94 to the web 92 by corners 102 and 104, respectively. The ramp 100 is angled and sized to define a gap 106 between corner 104 and central portion 40 and a dead air space 110 when the panels are interlocked as in FIGS. 6 and 7.

End 46 further includes a posterior portion 212 which has a leg 114 connected to the web 92 by a corner 116 to be posteriorly angled with respect to the web 92. A lip 120 is connected to a distal end 122 of the leg 114 by a corner 124. Web 92 and leg 114 are sized, and leg 114 is angled, so that when the webs 92 and 58 are abutting, the corner 124 abuts leg 74 of the cleft portion 70 and a dead air space 130 is formed.

Disconnection of interlocked panels is thus prevented by abutting corresponding elements of ends 44 and 46.

Figure 4:
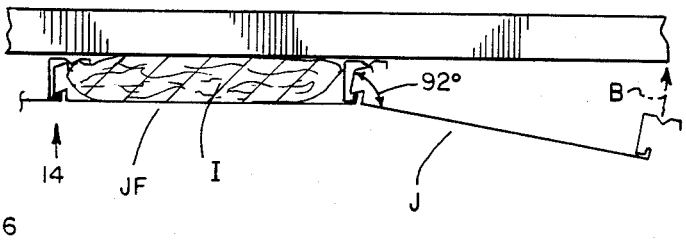
FIG. 4 is a top plan view of a planar wall panel unit embodying the teachings of the present invention showing an attachment process.
Figure 5:
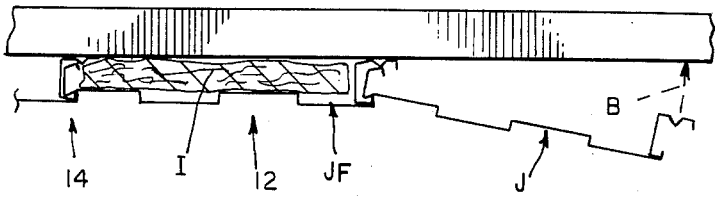
FIG. 5 is a top plan view of a fluted wall panel unit embodying the teachings of the present invention showing an attachment process.

Interlocking of the panels is illustrated by FIGS. 4 and 5 with panel assembly proceeding in direction F of FIG. 1. A panel J is joined to a panel JF by tilting panel J with respect to panel JF and forcing end 46 of the panel J into end 44 of panel JF. Initially, the hairpin 54 is received by the offset section 90, then panel J is rotated in the direction B. The corner 124 snaps past the cleft 70 and is held securely by engagement between that corner and leg 74. The panels are thus connected by the catch 14 with webs 58 and 92 in facially abutting contact. The angled nature of leg 114 causes this leg to interfere with the web 58, thereby keeping the joint 14 in tight alignment. In the preferred embodiment, the inside angle between leg 114 and 92 is obtuse, and preferably 112°. Also, prior to panel assembly, the web 92 of end 46 preferably has an angle of 92° with respect to the central portion 40 so that when two panels are snapped together, i.e., end 46 of a second panel is snapped into the end 44 of a first panel, there continues to be pressure exerted by the web 92 of the second panel against the web 58 of the first panel. This is another important feature of the invention for the purpose of keeping the panel joints tight.

The newly joined panel is then affixed to the appropriate building structural elements by clips 30 and screws 32. As indicated in FIGS. 4 and 5, insulation I can be positioned behind each panel as suitable. Insulation can be blanket, batt, or the like. Furthermore, gypsum wall board, insulation boards, and/or liners can be used in conjunction with the panels as suitable. Suitable molding, such as winged molding and/or "T" molding can also be used, if desired.

The panels 10 and/or 12 can also be used to retrofit existing buildings, and the elements and steps necessary to perform such retrofit will be evident to those skilled in the art from the teaching of the present disclosure. For this reason, details of such retrofit will not be herein presented.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. Wall panel structure for outside use on buildings comprising:
   - a plurality of elongated panel units of sheet material each having substantially parallel ends lengthwise thereof;
   - a first leg having a cleft portion thereon;
   - a first web attached to said first leg;
   - a hairpin portion attaching said first web to one end of a first panel unit;
   - an angled leg attached to a second web with the entire leg being at an obtuse angle of 112° with respect to the second web;
   - said second web being attached by an offset section having a void space to another end of said panel unit;
   - said second web being shorter than said first web;
   - whereupon upon assembly of a second panel unit with said first panel unit, the aforesaid hairpin portion of said first panel unit is received within the void space of the offset section of the second panel unit;
   - said angled leg having a lip at the free edge thereof for snap engagement with the cleft portion of an adjacent panel unit;
   - the lip of the angled leg of the second panel unit engaging the cleft portion of the first leg of said first panel unit for maintaining the assembled relationship of the first and second panel units; and
   - said second web attached by said offset section to another end of said panel unit being at 92° with respect to the central portion of the panel unit so that when two panels are snapped together, a continuous pressure is exerted between the webs of the respective panel units.

2. The wall panel structure defined in claim 1 wherein the panel unit includes a fluted central portion.

3. The wall panel structure defined in claim 1 wherein the panel unit includes a planar central portion.

4. The wall panel structure defined in claim 1 further including a reinforcing clip on said panel unit first end.

5. The wall panel structure defined in claim 1 wherein said cleft portion includes a V-shaped groove extending lengthwise of the panel unit.

6. The wall panel structure as defined in claim 1, wherein an apex of the cleft portion of said first leg is located further from said first web than is the hairpin portion which attaches said first web to said first panel unit.

7. The wall panel structure as defined in claim 1, wherein dead air spaces are provided at the interlocking joints between respective pairs of panel units after assembly thereof.

* * * * *